US011517915B2

(12) United States Patent
Hommel et al.

(10) Patent No.: US 11,517,915 B2
(45) Date of Patent: Dec. 6, 2022

(54) ROCK PROCESSING MACHINE HAVING AN IMPROVED CONTROL PANEL

(71) Applicant: Kleemann GmbH, Göppingen (DE)

(72) Inventors: Timo Hommel, Rechberghausen (DE); Tobias Klöss, Bad Grönenbach (DE); Reiner Köpf, Gingen an der Fils (DE)

(73) Assignee: Kleemann GmbH

( * ) Notice: Subject to any disclaimer, the term of this patent is extended or adjusted under 35 U.S.C. 154(b) by 254 days.

(21) Appl. No.: 17/017,093

(22) Filed: Sep. 10, 2020

(65) Prior Publication Data

US 2021/0107012 A1 Apr. 15, 2021

(30) Foreign Application Priority Data

Oct. 8, 2019 (DE) ..... 10 2019 126 978.4

(51) Int. Cl.
*B02C 25/00* (2006.01)
*B02C 21/02* (2006.01)
*B02C 1/02* (2006.01)

(52) U.S. Cl.
CPC ..... *B02C 25/00* (2013.01); *B02C 1/02* (2013.01); *B02C 21/02* (2013.01); *B02C 21/026* (2013.01)

(58) Field of Classification Search
CPC ..... B02C 25/00; B02C 21/02; B02C 21/026; B02C 1/005
See application file for complete search history.

(56) References Cited

U.S. PATENT DOCUMENTS 4,578,185 A * 3/1986 Wilson ..... B02C 23/18 210/251
4,801,098 A * 1/1989 Cook ..... B02C 23/18 241/261.2
7,147,175 B2 12/2006 Ikegami et al.
9,380,913 B2 * 7/2016 Golino ..... A47J 43/046
(Continued)

FOREIGN PATENT DOCUMENTS

EP 1433531 A1 6/2004
GB 1548746 A 7/1979
(Continued)

OTHER PUBLICATIONS

German Office Action for corresponding patent application No. 10 2019 126 978.4, dated Aug. 10, 2020, 5 pages (not prior art).
(Continued)

*Primary Examiner* — Faye Francis
(74) *Attorney, Agent, or Firm* — Lucian Wayne Beavers; Patterson Intellectual Property Law, PC

(57) ABSTRACT

A rock processing machine having functional units and a control panel that switches the rock processing machine, in a starting switching operation and, in a stopping switching operation. The control panel includes a plurality of state switching elements with which, for at least one functional unit, a state transition is associated in such a way that actuation of the state switching element on the functional unit brings about a state transition. A first set of switching elements participates in the starting switching operation, and a second set of switching elements, participates in the stopping switching operation; each set being arranged in a visually perceptible spatial arrangement that corresponds to a predetermined actuation sequence.

20 Claims, 2 Drawing Sheets

(56) References Cited

U.S. PATENT DOCUMENTS

| | | | | |
|---|---|---|---|---|
| 10,744,508 | B1 * | 8/2020 | Chang | B02C 25/00 |
| 2008/0067270 | A1 * | 3/2008 | Strutz | B02C 25/00 241/36 |
| 2008/0230638 | A1 * | 9/2008 | Lin | B02C 23/00 241/36 |
| 2010/0091103 | A1 * | 4/2010 | Peltonen | B02C 25/00 348/82 |
| 2011/0139913 | A1 * | 6/2011 | Fried | B02C 25/00 241/222 |
| 2013/0313351 | A1 | 11/2013 | Beam, III | |
| 2020/0238298 | A1 * | 7/2020 | Beau | A47J 27/004 |
| 2020/0246804 | A1 | 8/2020 | Eckert et al. | |
| 2022/0001390 | A1 * | 1/2022 | Cesena | B02C 25/00 |
| 2022/0097076 | A1 * | 3/2022 | Meier | B02C 13/095 |

FOREIGN PATENT DOCUMENTS

| | | | |
|---|---|---|---|
| WO | 2018136403 | A1 | 7/2018 |
| WO | 2019081186 | A1 | 5/2019 |

OTHER PUBLICATIONS

European Search Report for corresponding patent application No. 20200265, dated Mar. 16, 2021, 12 pages (not prior art).

* cited by examiner

ROCK PROCESSING MACHINE HAVING AN IMPROVED CONTROL PANEL

CROSS-REFERENCES TO RELATED APPLICATIONS

This application claims benefit of German Patent Application No. 10 2019 126 978.4, filed Oct. 8, 2019, and which is hereby incorporated by reference.

BACKGROUND OF THE DISCLOSURE

1. Field of the Disclosure

The present invention relates to a rock processing machine which comprises a plurality of different functional units that are each, at different times, activatable from an inactive state into an active state and deactivatable from the active state into the inactive state; the rock processing machine comprising a control panel that is embodied to switch the rock processing machine, in a starting switching operation constituting an operating state switching operation, from a less-active operating state into a more-active operating state and, in a stopping switching operation constituting an operating state switching operation, to switch it from a more-active operating state into a less-active operating state; more functional units being activated in the more-active operating state than in the less-active operating state; the control panel comprising a plurality of state switching elements constituting switching elements; a state transition being associated with each state switching element from among the plurality, for at least one functional unit, in such a way that actuation of the state switching element on the functional unit brings about, beyond an operating state switching operation, a state transition between the inactive state and the active state.

2. Description of the Prior Art

Rock processing machines of this kind, as known e.g. from WO 2019/081186 A (U.S. 2020/246804), are, for example, crushing machines for comminution of rock material, screening machines for particle-size-related sorting of granular rock material, or combined crushing and screening machines. The present invention preferably relates to mobile rock processing machines that can arrive at and then depart from their utilization site in self-propelled fashion. Because of their heavy dead weight, mobile rock processing machines as rule are machines that are movable on tracks and have a track drive unit.

Rock processing machines of this kind (hereinafter also referred to simply as "machines") encompass a plurality of functional units that, starting with a shut-down machine, must be activated in a predetermined sequence in order ultimately to bring the machine into an operationally ready operating state.

Because activation of functional units in a sequence deviating from the predetermined sequence can result in damage to the machine, or simply does not work, attempts have been made in the past, by way of various configurations of control panels, to avoid or at least reduce incorrect operation of the machine due to an incorrect activation sequence of the functional units.

In principle, switching elements on control panels have hitherto usually been arranged in consideration of the space that is available. Control panels are known in which, starting from an operating state of the machine achieved in the interim, the respective switching element to be actuated next in time in the predetermined sequence is indicated to the operator visually, for instance by illumination or flashing. Also known are display screens on control panels which indicate to the operator the respective switching element to be actuated next in time in the predetermined sequence.

In addition to indicating the next switching element to be actuated, in order to avoid incorrect operation it is also known to activate for actuation, starting from an operating state that has been arrived at, only the respective switching element to be actuated next, while all other switching elements are set to be nonfunctioning. If the operator then deviates from the predefined actuation sequence, however, it can occasionally happen that, because of the ineffective actuation of a switching element that was merely not "in sequence," the machine is believed to be defective, which can result in an undesired production outage.

SUMMARY OF THE DISCLOSURE

The object of the present invention is therefore to enhance the control reliability of the machine recited previously during the aforementioned operating state switching operations (starting switching operation and stopping switching operation), to prevent incorrect operation.

This object is achieved according to the present invention, in a rock processing machine of the kind recited previously, in that only exactly one state transition is associated with each state switching element from among the plurality of state switching elements for at least one functional unit. The result is to constitute a first set of switching elements that participates in the starting switching operation, and a second set of switching elements, different from the first, which participates in the stopping switching operation. Each set of switching elements is arranged on the control panel in a visually and/or haptically perceptible spatial arrangement relationship that corresponds to a predetermined actuation sequence of the switching elements of the respective set.

It is thus possible to associate with a state switching element exactly one, or more than one, functional unit whose activation state (active or inactive state) is modifiable by actuation of the state switching element. For at least one, preferably for each, functional unit switchable by the state switching element, however, only one change of state is associated with the state switching element. If a functional unit is already in the target state of the change of state, an actuation of the state switching element remains ineffective at least for that functional unit.

The first set contains switching elements that participate only in the starting switching operation. The second set contains switching elements that participate only in the stopping switching operation. These are preferably those state switching elements that are respectively associated, for at least one associated functional unit, preferably respectively for all associated functional units, with only one change of state in each case. As will be shown below, the first and the second set can also comprise at least one shared switching element that participates in both the starting and the stopping switching operation.

According to the present invention, the state switching elements are arranged along a visually and/or haptically perceptible actuation sequence path. The actuation sequence path and the progression direction within the latter are indicated in visually and/or haptically perceptible fashion. As a result of the spatial arrangement relationship corresponding to the predetermined actuation sequence, each state switching element from among the plurality of state switching elements has arranged physically closest to it, in the progression direction of actuation along the actuation sequence path, the respective state element to be actuated next in the predetermined actuation sequence.

Preferably all the switching elements of the starting switching operation and of the stopping switching operation are arranged successively in a progression direction along a shared actuation sequence path.

As a result of the association, indicated for the state switching elements, of only exactly one state transition with the at least one functional unit, separate state switching elements are provided on the one hand for activation, and on the other hand for deactivation, of the relevant functional unit. This makes possible on the one hand separation of the state switching elements into the first set of switching elements for the starting switching operation and the second set of switching elements for the stopping switching operation. On the other hand, this facilitates a rigorous and strict spatial arrangement of the state switching elements in accordance with the predetermined actuation sequence along the actuation sequence path.

The indication of the change of state "beyond an operating state switching operation," i.e. beyond the starting switching operation or the stopping switching operation, is intended to mean that what is important for assessing the change of state is not a merely temporary change in the activation state of a functional unit during the operating state switching operation. It is therefore intended to be immaterial whether a functional unit (for whatever reason) becomes activated and deactivated again or vice versa, optionally several times, during the operating state switching operation. All that is relevant is whether the functional unit has a different activation state after the operating state switching operation than before the operating state switching operation.

In principle, the less-active operating state can be any operating state in which the number of activated functional units is smaller than in the more-active operating state. Because the starting switching operation is preferably intended to result in establishment of full operational readiness of the rock processing machine, in the more-active operating state the machine is preferably in full operational readiness, in which the machine is completely ready for work as intended or is processing rock as intended.

The less-active operating state can be an operating state of complete machine shutdown, or can be a standby operating state in which basic functional units, for example a control apparatus and a basic energy supply system for the machine, are activated, but working apparatuses for transporting and for processing both rock material and segregated material, for example metal reinforcements, that occur and/or become released during rock processing, are deactivated.

For better differentiation of the starting switching operation, the first set can comprise a first state switching element, actuation of which activates a first energy supply system constituting a functional unit. This first energy supply system can be an internal combustion engine, for instance a diesel engine, which, constituting a kind of machine power plant for the machine, furnishes requisite operating energy, if applicable after conversion into other forms of energy, for instance as hydraulic pressure by driving a hydraulic pump, as pneumatic pressure by driving a pneumatic pump, as electrical energy by driving a generator, etc.

The first set can furthermore comprise a second state switching element, actuation of which activates at least one working apparatus, for example a crusher, crusher extractor conveyor, delivery chute, side discharge conveyor, and the like, constituting a further functional unit. In the case of a mobile machine, a propulsion-generating drive unit and a steering apparatus also represent working apparatuses for purposes of the present Application.

The second set can likewise comprise a third state switching element, actuation of which deactivates at least one working apparatus. The third state switching element is preferably embodied to deactivate the same working apparatuses that were activated by the second state switching element. In order for the stopping switching operation to be at least in portions a reversed image of the starting switching operation, which requires substantially the same actuations as the starting switching operation but in the opposite sequence, the second set can comprise a fourth state switching element, actuation of which deactivates the first energy supply system.

It is not to be excluded that the first state switching element is embodied to activate, by way of its actuation, not only the first energy supply system but at least one further functional unit. The exclusive function of activation of the first energy supply system by the first state switching element is, however, preferred. The same applies, mutatis mutandis, to the deactivatability of at least one further functional unit by the fourth state switching element.

As a rule, the rock processing machine comprises a plurality of working apparatuses in order to allow different rock processing tasks, for instance transport, comminution, sorting, separation, to be performed in a complex practical interrelationship in one machine. The rock processing machine then preferably comprises a data memory in which is stored a starting control instruction sequence according to which a plurality of working apparatuses is activated in a predetermined chronological order. Execution of the starting control instruction sequence stored in the data memory makes it possible to ensure that the plurality of working apparatuses is activated in the correct sequence without further external influence. The chronological order can consist merely in indication of an activation sequence. The chronological order can furthermore contain further conditions, for instance that a working apparatus to be activated earlier must first have reported back, to the control apparatus processing the starting control instruction sequence, an information item representing attainment of its active state, before a working apparatus to be activated later can be activated. A stopping control instruction sequence, which defines the deactivation of a plurality of working apparatuses in a predetermined chronological order, can also be stored in the data memory. Actuation of the second state switching element then brings about execution of the starting control instruction sequence. Actuation of the third state switching element brings about execution of the stopping control instruction sequence.

For an impact crushing machine constituting a possible embodiment of a rock processing machine according to the present invention, the starting control instruction sequence can contain, by way of example, activation of the following working apparatuses in the order indicated: impact crusher (comminution mechanism)>fines conveyor (transport)>transfer conveyor (transport)>return conveyor (transport)>post-screen (sorting)>magnetic conveyor (sorting/transport)>crusher extractor conveyor (transport)>extractor chute (transport)>prescreen conveyor (transport)>prescreen (sorting)>delivery chute (transport).

The stopping control instruction sequence can contain deactivation of all the aforementioned working apparatuses, for example in the order indicated below: delivery chute>prescreen>impact crusher>prescreen conveyor>discharge chute>crusher extractor conveyor>magnetic conveyor>post-screen>transfer conveyor>return conveyor>fines conveyor.

For a jaw crushing machine constituting a further embodiment of a rock processing machine according to the present invention, the starting control instruction sequence can contain activation of the following working apparatuses in the order indicated: magnetic conveyor>crusher extractor conveyor>extractor chute>jaw crusher (comminution mechanism)>prescreen conveyor>prescreen>delivery chute. The sequence of deactivated working apparatuses in the stopping control instruction sequence can correspond here, by way of example, to a sequence, executed in reverse, of the activated working apparatuses of the starting control instruction sequence.

As shown in the above examples, the sequence of deactivating working apparatuses in accordance with a stopping control instruction sequence can be simply a reversal of the sequence of activating the same working apparatuses. That need not, however, be the case.

Be it noted for clarification that in principle a state switching element is connected signal-transferringly to a control apparatus in such a way that actuation of the state switching element initiates a control operation in the control apparatus.

Safety plays a major role in rock processing machines, which as a rule can crush several hundred tons of rock per hour. The machine, in particular the control panel, can therefore comprise at least one additional state switching element that, for reasons having to do with the operational safety of the machine, occupies such a large physical volume that the installation space needed in order to arrange it in the actuation progression direction, firstly in the first set and again in the second set, is not available. This can be the case, for example, for a switching element that must be able to transfer and disconnect a high level of electrical power. A switching element of this kind can be, for example, an electrical main switch through which flows much of the current, or all of the electrical current, delivered to the functional units activatable at least by the second state switching element. It is impossible here to associate only one change of state with such a switching element. A single such switching element must be able to connect and disconnect an electrical circuit.

An incorporation of an extraordinary special state switching element of this kind, by activation of which a second energy supply system can be both activated and deactivated, into the spatial arrangement of the state switching elements which is based on the actuation sequence can be implemented by the fact that an actuation of the special state switching element is represented, both in the first set and in the second set, by an information symbol that constitutes a pseudo-switching element and is spatially arranged in accordance with the respective actuation sequence, i.e. along the actuation sequence path. To ensure simplicity and clarity in the actuation of the switching elements of the starting and stopping switching operations, the pseudo-switching element is preferably the only non-physical switching element, of both the first and the second set, arranged in the actuation sequence path. But because it is arranged, in the spatial arrangement of the switching elements of the machine based on the actuation sequence, at a location corresponding to its actuation in the actuation progression, and only one change of state is therefore associated with it, the pseudo-switching element is also a state switching element for purposes of the present Application.

As already stated above, the less-activated state can be a machine shutdown, after the establishment of which an operator can leave the machine. For that purpose, the first set and the second set of switching elements can comprise a shared control voltage switch, by actuation of which at least a plurality of switching elements of the first and of the second set is activatable and deactivatable for signal transfer upon actuation thereof. Preferably, the entire machine can be shut down, or can be brought from shutdown into a starting readiness state, by way of the control voltage switch. Because of this fundamental significance of the control voltage switch for machine operation, it is preferably actuatable only with the use of an authentication security means. The authentication security means can be stored in a data memory that is separate from the control panel, or can be implemented as a physical security means, e.g. in the form of a mechanical key. The control voltage switch is therefore preferably a robust key switch.

In particular, but not only, when the machine is a mobile machine, the machine can have more than one operating mode, for example a production mode, a maintenance mode, and optionally a travel mode. For selection of a desired operating mode, the first set can comprise a selection switching element, by actuation of which an operating mode is selectable from among a plurality of operating modes of the rock processing machine.

Logically, the selection switching element is arranged after the control voltage switch in the spatial arrangement relationship, since as a rule the machine firstly has to be brought from shutdown into a readiness state in which the selection switching element is then in fact activated for the transfer of signals. Because, on the other hand, different starting and/or stopping control instruction sequences can be stored in the data memory depending on the operating mode selected, the selection switching element is arranged preferably before the second state switching element, particularly preferably also before the first state switching element, in the spatial arrangement of the first set of switching elements which corresponds to the actuation progression. Depending on the number of selectable operating modes, the selection switching element can be, for example, a rocker switch for only two selectable operating modes, or a rotary switch for more than three selectable operating modes.

Selection of an operating mode between two starting switching operations is not necessary in every case. The operating mode that is already selected can also simply remain unchanged, so that no actuation of the selection switching element is required. In order to allow the control system to be given an active notification regarding the selection of an operating mode even without actuation of the selection switching element, the first set can comprise a confirmation switching element, actuation of which generally confirms a setting state of the rock processing machine which is determined by switching elements arranged in the actuation sequence before the confirmation switching element. Additionally or alternatively, the confirmation switching element can bring a control apparatus into a predetermined operating state, for instance by the fact that an emergency shutoff switch, often stipulated for safety reasons, and an emergency shutoff circuit connected thereto, are activated; and/or can configure a data memory in a predetermined manner, for instance by the fact that it deletes error messages of a previous operating phase from the present working memory and/or writes them into an archive memory.

Specifically after an emergency shutoff of the machine, the control voltage switch and the selection switching element for selecting one of several operating modes are already in the desired switch position. The machine can then be quickly and safely put back into operation proceeding from the confirmation switching element.

The visual and/or tactile perceptibility of the spatial arrangement relationship that reproduces the predetermined actuation sequence of the switching elements can be achieved, in the simplest case, by a simple straight-line linear serial arrangement of the switching elements, for example all below one another or all next to one another, on a control area of the control panel.

A simple arrangement of this kind, however, requires either a correspondingly large dimension for the control area or an arrangement of the switching elements with a correspondingly small spacing from one another, which in turn increases the risk of incorrect operation. Visual and/or haptic perception of the predetermined actuation sequence can be achieved, with a comparatively large spacing between the switching elements simultaneously with a comparatively small available installation space for arrangement of the switching elements, by the fact that it is the case for a plurality of switching elements that a visually perceptible direction-indicating symbol and/or a haptically perceptible direction-indicating spatial configuration is arranged between two switching elements that follow one another in accordance with the predetermined actuation sequence, the symbol and/or the configuration pointing toward the respective next switching element in the predetermined actuation sequence. The direction-indicating symbol can be, for example, an arrow or a triangle or a symbol of any conformation having a direction-indicating tip. The haptic configuration can be, for example, a projection or a depression in the surface of the control area which preferably not only can be felt but also, by casting a shadow, achieves visual perceptibility. The haptic configuration can be, for example, an elevated or recessed edge of the visual symbol, so that visual and haptic perceptibility are achievable without additional installation space. Thanks to the haptic configuration, the actuation sequence information placed on the control area can be retrieved by the operator even in poor lighting conditions or if the control area is heavily soiled.

In order to make the starting switching operation completely unequivocally distinguishable from the stopping switching operation for an operator, the symbols and/or configurations of the first set can visually and/or haptically differ from the symbols and/or configurations of the second set. For example, the symbols of the two sets can have different colors. Additionally or alternatively, the symbols and/or configurations of the two sets can have different textures. At least some, preferably all, of the switching elements can also differ, for instance by way of a different color and/or shape, from the switching elements of the second set in order to decrease their ability to be confused.

When, as is preferred, the starting and stopping switching operations transfer the machine between a shutdown and an operationally ready operating state, the switching elements necessary for execution of the operating state switching operations having the symbols and/or configurations of the first set which are arranged between them, and the switching elements having the symbols and/or configurations of the second set which are arranged between them, can be arranged not only on a comparatively small installation space on the control panel, but also in a particularly quickly and easily intuitively comprehensible manner, along a continuously recirculating actuation sequence path. The end point of the starting switching operation is then the beginning point of the stopping switching operation, and vice versa.

In principle, the switching elements can be switching surfaces of a multifunction switching area, for instance of a touchscreen, in which surface regions only temporarily possess the functionality of switching elements. In selected operating phases, surface regions of the multifunction switching area can be occupied by differing functions. This is not, however, preferred. In the surroundings of the control area which are greatly affected by dirt and vibration, robust switching elements that reliably actuate, and in particular reliably do not actuate, even in the aforementioned difficult conditions, are preferred. The switching elements, with the exception of the aforementioned pseudo-switching element depicted merely as a symbol, are therefore preferably mechanical switching elements, for the actuation of which a respective switch body is arranged displaceably relative to a switch base mounted on the control panel. It is thereby possible to define switching travels of the switch body which must be reliably effected for an actuation of the switching element. The risk of vibration- or dirt-related incorrect actuation of a switching element without an action by the operator can be decreased or even precluded by way of sufficiently long switching travels and, optionally, sufficiently large required switching forces.

In order to further enhance the visual perceptibility of the predetermined actuation sequence, the machine, and in particular the control panel, can comprise a control apparatus that is embodied to perceptibly indicate after actuation of a switching element, by visual and/or haptic emphasis in relation to the remaining switching elements, the switching element that is to be actuated next in the actuation sequence. For example, the respective switching element, and/or a region of the control area of the control panel which surrounds only the respective switching element, can be temporarily illuminatable.

In order to make possible effective output of an abundance of different information, the control panel preferably comprises a multifunction indicating apparatus, for instance a display screen.

In order to enhance the operating reliability of the switching element arrangement during the starting and stopping switching operations, the multifunction indicating apparatus can be embodied to display, after actuation of a switching element, an information item that represents the switching element that is to be actuated next in the actuation sequence.

Additionally or alternatively, in order to inform the operator as to the progress of an operating state switching operation, the multifunction indicating apparatus can be embodied to display, after actuation of the second and/or of the third state switching element, an information item regarding the activation state of the plurality of working apparatuses which is to be respectively activated or deactivated by those switching elements.

In order to execute the starting and stopping switching operations, the control area of the control panel preferably comprises only the switching elements recited above: control voltage switch, selection switching element, confirmation switching element, state switching elements, and the pseudo-switching element. The control area can additionally comprise the special state switching element, although the latter, because of its size, can also be arranged outside the actuation sequence path in which the remaining aforesaid switching elements of the starting and stopping switching operations are arranged.

Several rock processing machines can be operated one behind another in a machine combination, so that a processing result of a machine that precedes in the combination is the starting material of a following machine.

BRIEF DESCRIPTION OF THE DRAWINGS

The present invention will be explained in further detail below with reference to the appended drawings, in which.

DETAILED DESCRIPTION

Figure 1:
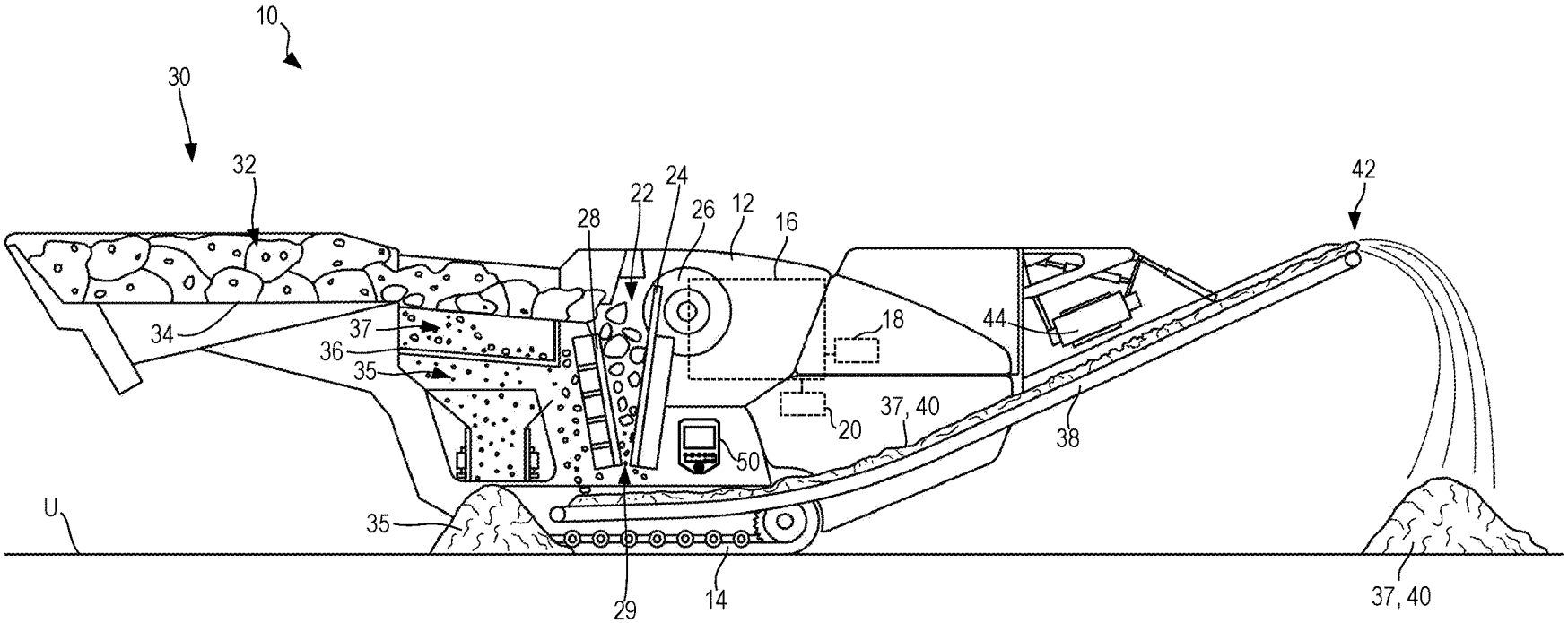
FIG. 1 is a schematic outline view of an embodiment according to the present invention of a rock processing machine of the present Application.

An exemplifying rock processing machine, as disclosed in WO 2019/081186 A (U.S. 2020/246804), is labeled in FIG. 1 in general with the number 10. Machine 10 encompasses a machine frame 12 that is supported on a supporting substrate U via a track drive unit 14 that is known per se. Machine 10 is consequently a mobile rock processing machine 10 that, with its track drive unit 14 constituting a functional unit, can travel independently to its utilization site at least from a transport apparatus, for example a lowboy trailer.

Machine 10 encompasses as a further functional unit an internal combustion engine 16, for instance a diesel engine, that constitutes a central power plant of machine 10. Internal combustion engine 16 can, for example, drive a hydraulic motor 18 and an electrical generator 20, so that when internal combustion engine 16 is in operation, a predetermined hydraulic pressure level, and an electrical energy supply beyond merely electrical energy stored in batteries, is available on machine 10.

Machine 10 comprises as a further functional unit a determining working apparatus, namely a jaw crusher 22. The right (in FIG. 1) crushing jaw 24 is driven by a cam 26 to move reciprocatingly toward and away from machine-frame-mounted crushing jaw 28, with an oscillating change in crushing gap 29 existing between crushing jaws 24 and 28. The motion of cam 26 is furnished by internal combustion engine 16.

Jaw crusher 22 is loaded via a delivery unit 30 with material 32 to be comminuted in jaw crusher 22. As a functional unit and working apparatus, machine 10 comprises a delivery chute 34 that, constituting a vibratory conveyor, conveys material 32 placed therein to a double-decker prescreen 36. Double-decker prescreen 36 is driven during operation to vibrate circularly, and likewise constitutes a functional unit and working apparatus. A fines component 35 and a component 37 having a medium grain size are separated therein and conveyed separately from the remaining material 32. Fines component 35 can be, for example, directed out of machine 10. Medium grain size component 37 can be conveyed directly onto crusher extractor conveyor 38, which constitutes a further functional unit and working apparatus and which also conveys comminuted material 40, emerging from jaw crusher 22 after passing therethrough, away from jaw crusher 22 to an ejection location 42 from which material 40 that has been comminuted as intended is discharged.

Along the conveying path from crusher gap 29 to ejection location 42, material 37 and 40 is carried past a further functional unit that is also a working apparatus. This is magnetic separator 44, which is operated with electrical energy and which magnetically segregates ferromagnetic components, for instance steel reinforcements, out of comminuted material 37 and 40 and conveys the segregated ferromagnetic material away from machine frame 12 in a direction projecting out from the drawing plane of FIG. 1.

Machine 10 is controlled by a control panel 50, arranged by way of example laterally on machine frame 12, which will be explained in further detail below in conjunction with FIG. 2.

Figure 2:
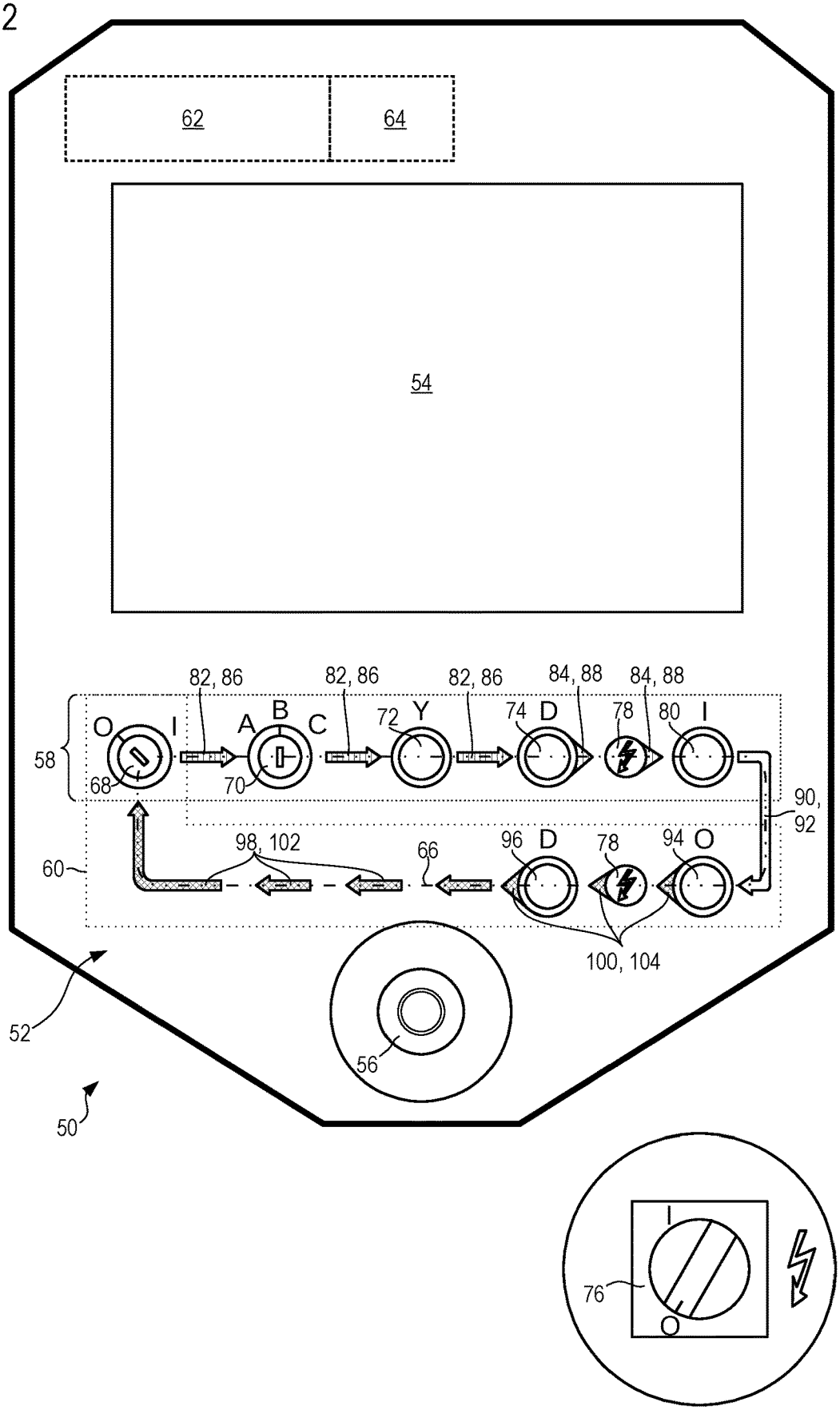
FIG. 2 is a schematic plan view of the control area of a control panel of the rock processing machine of FIG. 1.

FIG. 2 depicts, in a schematic plan view, control panel 50 that is merely indicated in FIG. 1. Arranged on a control area 52 facing toward an actuating operator are a multifunction indicating apparatus 54, for instance a touchscreen; an emergency shutoff switch 56 known per se; a first set 58 of switching elements; and a second set 60, separate therefrom, having further switching elements.

Control panel 50 furthermore comprises a control apparatus 62 indicated merely with dashed lines, and a data memory 64 also indicated merely with dashed lines. The control apparatus 62 may also be referred to as a controller 62.

Control apparatus 62 is signal-transferringly connected to multifunction indicating apparatus 54, to the switching elements of control area 52, and to a machine control system, and transfers control instructions, inputted by an operator via control area 52, to the machine control system, which applies control to the relevant functional units 14, 16, 22, 34, 36, 38, and 44 on the basis of the transferred control instructions.

First set 58 of switching elements serves for execution of a starting switching operation, by which machine 10 is intended to be switched from a completely shut-down operating state into an operating state that is operationally ready for comminution operation as intended.

Second set 60 of switching elements serves to execute a stopping switching operation, by which machine 10 is intended to be switched from the operationally ready operating state back into the shut-down operating state.

The switching elements of first set 58 and of second set 60 are arranged, successively clockwise (when viewing FIG. 2) in accordance with their actuation sequence, along a continuously recirculating actuation sequence path 66. When the plurality of different functional units disclosed herein are described as being each activatable at different times it is mean that the functional units are activated in sequence one after the other, and not simultaneously.

First set 58 and second set 60 contain a control voltage switch 68 in the form of a key switch, which is the first switching element of first set 58 to be actuated and the last switching element of second set 60 to be actuated. Control voltage switch 68 can be switched between the "on" and "off" states, represented by the symbols "I" for "on" and "O" for "off." With control voltage switch 68 in the "on" state, control panel 50 is supplied with electrical energy and the switching elements of first set 58 and of second set 60 are activated. The switching of control voltage switch 68 into the "on" state can furthermore result in further activations on machine 10, for example supplying basic electrical energy to control apparatuses.

In the starting switching operation, the switching on of control voltage switch 68 is followed by selection of an operating mode, from among a plurality of operating modes A, B, or C, using selection switching element 70. Selection switching element 70 is preferably likewise configured as a key switch in order to ensure that only a sufficiently authorized operator can modify the operating mode of machine 10.

In the actuation sequence of the starting switching operation, selection switching element 70 is followed by a confirmation switching element 72 in the exemplifying form of a pushbutton. Actuation of confirmation switching element 70 confirms, during a starting switching operation, that an operating mode has been selected and that the switch positions of selection switching element 70 will not be further modified. The actuation of confirmation switching element 72 can additionally bring control apparatus 62 and/or data memory 64 into a predetermined initial state for the selected operating mode. For example, an error memory from a previous, completed operating phase can be deleted or archived, and operating parameters of control apparatus 62 can be initialized.

In the actuation sequence of first set 58 for executing the starting switching operation, actuation of confirmation switching element 72 is followed by actuation of a first state switching element 74, once again in the form of a pushbutton. First state switching element 74 starts diesel engine 16, constituting the basic power plant of machine 10. A first energy supply system is therefore available to machine 10 once first state switching element 74 is actuated, since the energy of the diesel engine, by driving corresponding accessories, makes available hydraulic pressure, optionally pneumatic pressure, and electrical energy beyond that of a battery reservoir.

Along actuation sequence path 66, first state switching element 74 is followed in the actuation sequence by activation of the electrical energy supply of the functional units, and in particular of working apparatuses 14, 22, 34, 36, 38, and 44 of machine 10, by actuation of a special state switching element 76 arranged outside first set 58 and outside second set 60. Special state switching element 76 is preferably likewise arranged on control panel 50, but can also be arranged remotely therefrom. Special state switching element 76 can also be arranged on control panel 50, but not on control area 52 and instead, for instance, on a lateral surface of control panel 50.

For safety reasons, all electrical power switched by special state switching element 76 flows via special state switching element 76 itself, and for that reason it occupies a physical volume that prevents placement in actuation sequence path 66. Because of this power transfer, special state switching element 76 is also referred to among specialists as a "main switch."

Special state switching element 76 furthermore switches both from "on" to "off" and from "off" to "on." Special state switching element 76 therefore has two state transitions for the same technical function content (here, electrical energy supply) associated with it, whereas only exactly one state transition is associated with first state switching element 74, and with the subsequent second state switching element 80, for each function unit switchable by switching elements 74 and 80 between an inactive and active state. The electrical energy supply system activated in the starting switching operation must be deactivated again in the stopping switching operation. A realization of these two state transitions using two separate switching elements, however, would not be able to meet, or would meet only with an undesirably high outlay, the requirement (which exists for safety reasons) that the switched electrical power also flow via the switching element that switches it.

Special state switching element 76 is therefore represented both in first set 58 and in second set 60, as a pseudo-switching element 78, merely by a symbol that indicates to the operator at control panel 50 that special state switching element 76 is to be actuated after first state switching element 74 in the actuation sequence. Pseudo-switching element 78 is, however, treated and regarded in the present Application, in the arrangement of the switching elements in first set 58 and in second set 60, as a switching element.

Pseudo-switching element 78, or the actuation of special state switching element 76, is followed in first set 58, as a final switching element, by second state switching element 80, once again in the exemplifying form of a pushbutton. A starting control instruction sequence, which control apparatus 62 executes upon actuation of second state switching element 80, is stored in data memory 64. In that starting control instruction sequence, beyond the starting switching operation, a plurality of functional units and working apparatuses 14, 16, 22, 34, 36, 38, and 44 has associated with it exactly one change of state, usually an activation.

The activation progress of machine 10 can be outputted on multifunction indicating apparatus 54 to accompany the actuation of the switching elements of first set 58, so that the operator at control panel 50 recognizes when the starting switching operation is complete and machine 10 is ready to operate.

In order to make the actuation sequence of switching elements 68 to 80 of first set 58 unequivocally recognizable for the operator, direction-indicating arrow symbols 82 or direction-indicating triangle symbols 84, depending on the space available, are arranged between the switching elements. Direction-indicating symbols 82 and 84 point, from a switching element that is to be actuated earlier, toward the switching element that is to be respectively actuated next, after actuation thereof, along actuation sequence path 66.

In the example depicted, symbols 82 and 84 are additionally embodied as respective haptically perceptible elevated configurations 86 and 88. By casting shadows, elevated configurations 86 and 88 assist not only the visual perceptibility of symbols 82 and 84 but furthermore can be felt even in poor lighting conditions or if control area 52 is heavily soiled.

A further direction-indicating arrow symbol 90, which is simultaneously a haptically perceptible elevated configuration 92, leads from the last switching element 80 of first set 58 to the first switching element 94 of second set 60. Switching element 94 is a third state switching element 94, actuation of which causes a stopping control instruction sequence stored in data memory 64 to be executed by control apparatus 62, with the result that functional units and working apparatuses 14, 16, 22, 34, 36, 38, and 44 that are stored in the stopping control instruction sequence are deactivated in a sequence stored in the stopping control instruction sequence. After complete execution of the stopping control instruction sequence, initiated by the actuation of third state switching element 94, machine 10 as a rule is in the same operating state as before actuation of second state switching element 80. This does not necessarily mean, however, that the stopping control instruction sequence is merely the reverse of the sequence of functional units and working apparatuses 14, 16, 22, 34, 36, 38, and 44 of the starting control instruction sequence, with a respectively associated opposite change of state.

After third state switching element 94 in the actuation sequence of the stopping switching operation, special state switching element 76, indicated on control area 52 by pseudo-switching element 78 in second set 60, must again be actuated. Because it is in the "on" state after the starting switching operation, the actuation of switching element 76 signifies a switching actuation into the "off" state.

The actuation of special state switching element 76, and thus the deactivation of an electrical power supply to the associated functional units and working apparatuses, is followed, in the actuation sequence along actuation sequence path 66, by a fourth state switching element 96 by which diesel engine 16 becomes deactivated. After the deactivation of diesel engine 16, what remains as the last actuation in the stopping switching operation is the actuation of control voltage switch 68, and withdrawal of the key required for actuation thereof.

The actuation sequence of switching elements 94, 78, 96, and 68 of second set 60 is once again indicated by direction-indicating arrow symbols 98 and direction-indicating triangle symbols 100, depending on available space, between the switching elements of second set 60. Once again, arrow symbols 98 and triangle symbols 100 are also respectively elevated configurations 102, 104 that can still be felt in poor lighting conditions and/or when heavily soiled, even though they might possibly no longer be recognizable by their color alone.

The different cross-hatching in FIG. 2 of direction-indicating symbols and configurations 82 to 88 of first set 58 on the one hand, and of direction-indicating symbols 98 to 104 of second set 60 on the other hand, indicates that direction-indicating symbols and configurations 82 to 88 of first set 58 have, for better differentiation, a different color and/or a different haptically detectable texture than direction-indicating symbols and configurations 98 to 104 of second set 60. Direction-indicating symbol 90, which at the same time is a direction-indicating configuration 92, likewise differs from the symbols and configurations of first and second set 58, 60 in terms of color and/or texture, since symbol 90 or configuration 92 does not belong only to first set 58 or only to second set 60.

If the operation of machine 10 as intended is firstly terminated by way of emergency shutoff switch 56, a resumption of the operation of machine 10 does not require another actuation of control voltage switch 68 or, as a rule, an actuation of selection switching element 70. In that case, after release of emergency shutoff switch 56, which is usually mechanically immobilized after actuation, operation of the machine is reestablished using a starting procedure that begins with confirmation switching element 72 as the first switching element to be actuated.

Control apparatus 62 is embodied to emphasize the respective switching element to be actuated next in an operating state switching operation, and indicate it to the operator, by illuminating that switching element.

For better clarity and thus in order to further reduce incorrect operation, state switching elements 80 and 94 on the one hand and 74 and 96 on the other hand, which are respectively associated with the same functional units but with opposite changes of state, are arranged on control area 52 in columnar fashion below one another, while all switching elements 70 to 80 of the starting switching operation and all switching elements 94, 78, and 96 of the stopping switching operation (with the exception of control voltage switch 68) are arranged in different rows next to another in rows. This arrangement can of course be interchanged as to rows and columns.

The risk of incorrect operation of machine 10 is considerably reduced with control panel 50 of FIG. 2.

The invention claimed is:

1. A rock processing machine, comprising:

a plurality of different functional units that are each activatable at different times from an inactive state into an active state and deactivatable from the active state into the inactive state, the functional units being selected from the group consisting of a track drive unit, an internal combustion engine, a jaw crusher, a delivery chute, a pre-screen, a crusher extractor conveyor and a magnetic separator of the rock processing machine; and a control panel including:

a first set of switching elements configured to switch the rock processing machine in a starting switching operation from a less-active operating state into a more-active operating state, more functional units being activated in the more-active operating state than in the less-active operating state, the first set of switching elements including at least one state switching element; and a second set of switching elements configured to switch the rock processing machine in a stopping switching operation from the more-active operating state into another less-active operating state, the second set of switching elements being at least in part different from the first set of switching elements and including at least one state switching element;

wherein each of the state switching elements is configured to bring about, beyond an operating state switching operation, only exactly one state transition between the inactive state and the active state for at least one of the functional units, wherein the starting switching operation and the stopping switching operation are each operating state switching operations; and wherein each of the first and second sets of switching elements is arranged on the control panel in a visually perceptible spatial arrangement relationship corresponding to a predetermined actuation sequence of the switching elements of the respective set.

2. The rock processing machine of claim 1, wherein:

each of the first and second sets of switching elements is arranged on the control panel in a haptically perceptible spatial arrangement relationship corresponding to the predetermined actuation sequence of the switching elements of the respective set.

3. The rock processing machine of claim 1, wherein:

the other less-active operating state associated with the second set of switching elements is identical to the less-active operating state associated with the first set of switching elements.

4. The rock processing machine of claim 1, wherein:

the at least one state switching element of the first set of switching elements includes:

a first state switching element actuation of which activates a first energy supply system, the first energy supply system being one of the functional units; and a second state switching element actuation of which activates at least one working apparatus, the at least one working apparatus being another of the functional units; and the at least one state switching element of the second set of switching elements includes:

a third state switching element actuation of which deactivates the at least one working apparatus; and a fourth state switching element actuation of which deactivates the first energy supply system.

5. The rock processing machine of claim 4, further comprising:

a plurality of working apparatuses, the plurality of working apparatuses including the at least one working apparatus;

a data memory including stored in the data memory:

a starting control instruction sequence configured to activate the plurality of the working apparatuses in a predetermined chronological order; and a stopping control instruction sequence configured to deactivate the plurality of the working apparatuses in a predetermined chronological order;

wherein the actuation of the second state switching element brings about execution of the starting control instruction sequence, and the actuation of the third state switching element brings about execution of the stopping control instruction sequence.

6. The rock processing machine of claim 4, wherein:

the control panel further includes a special state switching element configured to both activate and deactivate a second energy supply system; and each of the first and second sets of switching elements includes an information symbol providing a pseudo-switching element spatially arranged in accordance with the respective actuation sequence of the respective set of switching elements.

7. The rock processing machine of claim 4, further comprising:

a plurality of working apparatuses, the plurality of working apparatuses including the at least one working apparatus;

wherein the control panel further includes a multifunction indicating apparatus configured to display, after actuation of at least one of the second and third state switching elements, an information item regarding the active or inactive state of the plurality of working apparatuses.

8. The rock processing machine of claim 1, wherein:

each of the first and second sets of switching elements includes a shared control voltage switch configured such that by actuation of the shared voltage control switch a plurality of switching elements of the first set of switching elements and of the second set of switching elements are activatable and deactivatable.

9. The rock processing machine of claim 1, wherein:

the first set of switching elements includes a selection switching element configured to select an operating mode from a plurality of operation modes of the rock processing machine.

10. The rock processing machine of claim 9, wherein:

the first set of switching elements includes a confirmation switching element actuation of which confirms a setting state of the rock processing machine determined by the selection switching element.

11. The rock processing machine of claim 10, wherein:

actuation of the confirmation switching element brings a controller into a predetermined operating state.

12. The rock processing machine of claim 10, wherein:

actuation of the confirmation switching element configures a data memory in a predetermined manner.

13. The rock processing machine of claim 10, wherein:

actuation of the confirmation switching element confirms an operating mode selection without prior actuation of the selection switching element.

14. The rock processing machine of claim 1, wherein:

the control panel further includes a visually perceptible direction-indicating symbol arranged between two switching elements that follow one another in accordance with the predetermined actuation sequence, the symbol pointing toward the respective next switching element in the predetermined actuation sequence.

15. The rock processing machine of claim 14, wherein:

the control panel further includes a haptically perceptible direction-indicating symbol arranged between two switching elements that follow one another in accordance with the predetermined actuation sequence, the haptically perceptible direction-indicating symbol pointing toward the respective next switching element in the predetermined actuation sequence.

16. The rock processing machine of claim 14, wherein:

the visually perceptible direction-indicating symbols of the first set of switching elements differ from the visually perceptible direction-indicating symbols of the second set of switching elements.

17. The rock processing machine of claim 14, wherein:

the switching elements of the first set of switching elements having the visually perceptible direction-indicating symbols of the first set of switching elements arranged between them, and the switching elements of the second set of switching elements having the visually perceptible direction-indicating symbols of the second set of switching elements arranged between them, are arranged along a continuously recirculating actuation sequence path.

18. The rock processing machine of claim 1, wherein:

the switching elements are mechanical switching elements each including a respective switch body arranged displaceably relative to a respective switch base for actuation of the respective mechanical switching element.

19. The rock processing machine of claim 1, further comprising:

a controller configured to perceptibly indicate, after actuation of a switching element, by either or both of visual and haptic emphasis in relation to the remaining switching elements, the switching element that is to be actuated next in the predetermined actuation sequence.

20. The rock processing machine of claim 1, wherein:

the control panel further includes a multifunction indicating apparatus configured to display an information item representing a switching element that is to be actuated next in the predetermined actuation sequence.

* * * * *